US005099952A

United States Patent [19]

Farrell

[11] Patent Number: 5,099,952

[45] Date of Patent: Mar. 31, 1992

[54] LADDER LATERAL EXTENSION

[76] Inventor: Gary D. Farrell, 8413 Brentwood Rd., Omaha, Nebr. 68114

[21] Appl. No.: 719,515

[22] Filed: Jun. 24, 1991

[51] Int. Cl.[5] ..... E06C 7/16

[52] U.S. Cl. ..... 182/122; 182/93; 248/210

[58] Field of Search ..... 182/120, 121, 122, 229, 182/172, 93, 45; 248/210, 211, 212

[56] References Cited

U.S. PATENT DOCUMENTS

| | | | |
|---|---|---|---|
| 552,180 | 12/1895 | Hardouin . | |
| 1,515,420 | 11/1924 | Traylor . | |
| 1,880,319 | 10/1932 | Iasillo . | |
| 1,960,863 | 5/1934 | Boyer . | |
| 2,883,134 | 4/1959 | O'Halloran . | |
| 2,895,700 | 7/1959 | Johnson . | |
| 3,052,442 | 9/1962 | Rankin . | |
| 3,276,543 | 10/1966 | Kanoza | 182/122 |
| 3,985,203 | 10/1976 | Erlenbach | 248/210 |
| 4,515,242 | 5/1985 | LaChance | 182/106 |
| 4,600,079 | 7/1986 | McBride | 182/108 |
| 4,616,734 | 10/1986 | Phelps | 182/121 |

*Primary Examiner*—Reinaldo P. Machado
*Attorney, Agent, or Firm*—John A. Beehner

[57] ABSTRACT

A ladder lateral extension, adapted for use with a conventional ladder, includes a generally channel-shaped member adapted to be placed on the siderail of a ladder, such that the siderail fits within the channel-shaped member. The channel-shaped member has opposite interior and exterior sidewalls and a base. A pair of rung-receiving slots are formed in the exterior sidewall, which slots receive the rungs as the channel-shaped member is placed over the siderail. Extending perpendicularly outwardly from the exterior sidewall is a lateral support member of a length equal to or greater than the distance between the rung-receiving slots, thus providing a safe standing area. Safety for the user of the lateral ladder extension is thus greatly increased, due to the engagement of two rungs of the ladder and the length of the lateral support member, which allows the user to safely stand upon it.

6 Claims, 4 Drawing Sheets

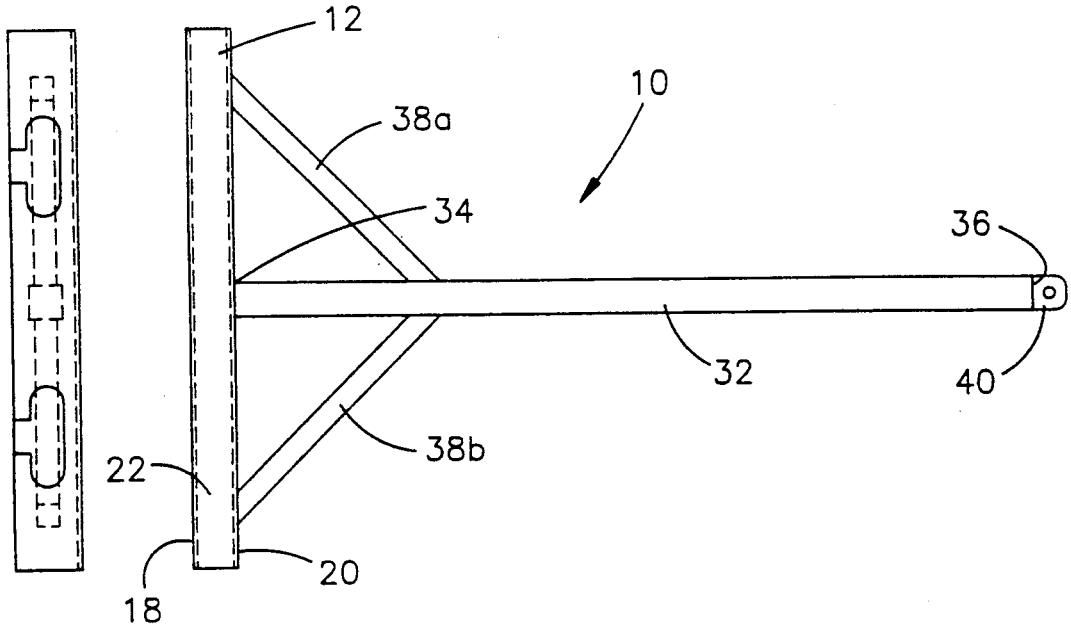
FIG. 4
FIG. 5
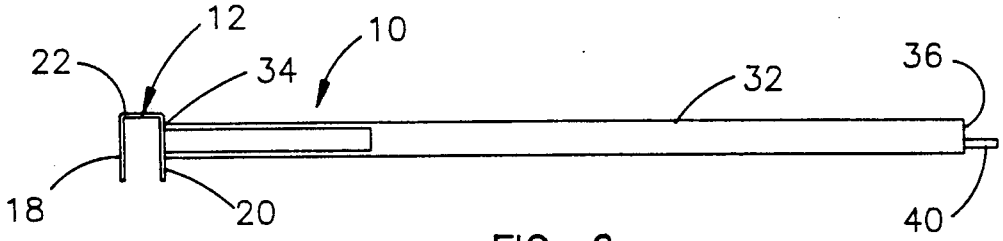
FIG. 6
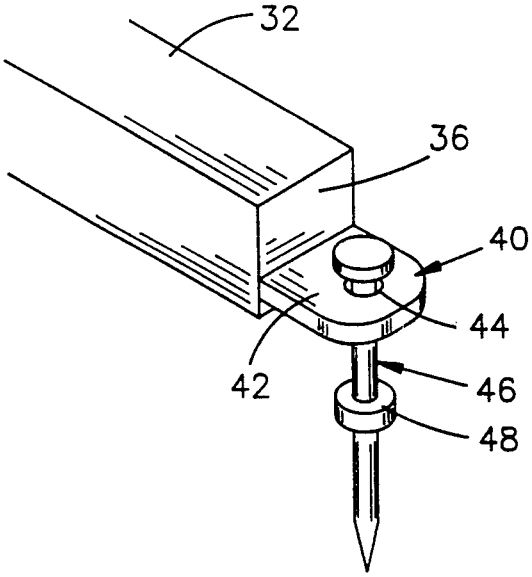
FIG. 7

LADDER LATERAL EXTENSION

BACKGROUND OF THE INVENTION

1. Technical Field

The present invention relates to a lateral extension for a ladder, and more particularly, to a ladder lateral extension which fits on the siderail of a ladder and which can support a person such as a fireman standing on the extension.

2. Description of the Prior Art

Firefighters face risks every day that would be unbearable for most people. Burns, smoke inhalation, and even death are everyday elements in the life of a firefighter. Firefighters also face the risks encountered in using ladders, such as slipping or falling. Two vital tasks performed by firefighters while on ladders are ventilation and overhaul. Ventilation involves opening a hole in the roof of a structure involved in a fire so that smoke and heat are released, thus enabling other firefighters with hose lines to enter a smoke filled building sooner and to locate the fire sooner. To form a ventilation hole, the firefighter generally uses a power saw, weighing between 50 and 60 pounds, to cut a hole in the roof to one side of the ladder. This puts an awkward strain on a firefighter's back. The hole may then be widened by chopping with an axe. Overhaul involves the same process, but is designed to extinguish smoldering fires under shingles or in the roof. Both of these operations are carried out under hazardous conditions and in precarious positions on a roof ladder, wearing bulky clothing and an air pack.

To increase the safety of the firefighter, an apparatus is needed that will enable a firefighter to work in front of himself rather than leaning over and trying to chop or saw at an awkward angle, and that will also reduce the chance of a firefighter falling from the ladder due to insecure footing.

The prior art provides no apparatus capable of fulfilling these needs. For example, Iasillo, U.S. Pat. No. 1,880,319, discloses a supporting bracket attachment for ladders for supporting a bucket, pail, or other similar article. Similarly, O'Halloran, U.S. Pat. No. 2,883,134, discloses a holder for paint buckets which also attaches to ladders. Neither disclosed device would fulfill the needs of the firefighter, as neither device could be safely stood upon to allow lateral movement of the firefighter.

Hardouin, U.S. Pat. No. 552,180, discloses a lateral support member which can be stood upon, however, the web of supporting lines and the hook engaging only one rung leads to the Hardouin device being neither stable nor easy to adjust, elements vital to the use and safety of firefighters. Thus, the prior art does not address or fulfill the needs of the present-day firefighter.

Accordingly, an object of the present invention is to provide a ladder lateral extension adapted for easy adjustment and for safely supporting a person standing thereon.

Another object of the present invention is to provide a ladder lateral extension adapted to fit on either siderail of a conventional ladder.

Yet another object of the present invention is to provide a ladder lateral extension which will save time for firefighters by not requiring movement of the ladder or a second ladder to reach the same work area.

Still another object of the present invention is to provide a ladder lateral extension which will allow a firefighter to work directly in front of himself or herself, thus lessening back strain and chance of injury.

Finally, an object of the present invention is to provide a ladder lateral extension which is simple and rugged in construction, economical to manufacture and safe and efficient in use.

SUMMARY OF THE INVENTION

The present invention provides a lateral extension for a ladder which assists firefighters in performing tasks laterally removed from a ladder.

The ladder lateral extension consists of a generally channel-shaped member adapted to be placed on the siderail of a ladder, such that the siderail fits within the channel-shaped member. The channel-shaped member has a pair of opposite interior and exterior sidewalls and a base. The interior sidewall has a pair of rung-receiving slots which receive the rungs as the channel-shaped member is placed over the siderail. Extending perpendicularly outwardly from the exterior sidewall is a lateral support member of length equal to or greater than the distance between the rung-receiving slots, thus providing a safe standing area.

By the extension engaging two rungs of the ladder, its stability is greatly increased, thus creating a safer work platform for firefighters. Also, by the lateral support member being of a length equal to or greater than the distance between the rung-receiving slots, a much improved work area is created, one which allows a firefighter to work directly in front of him, and thus chances for injury are greatly reduced.

BRIEF DESCRIPTION OF THE DRAWINGS

FIG. 4 is an end view of the present invention with dotted lines indicating hidden structure thereof.

FIG. 5 is a top plan view of the present invention.

FIG. 6 is a side elevational view of the present invention.

FIG. 7 is a partial perspective view of the present invention showing the spike, the spike holder, and the penetration limiting device.

DESCRIPTION OF THE PREFERRED EMBODIMENT

Figure 1:
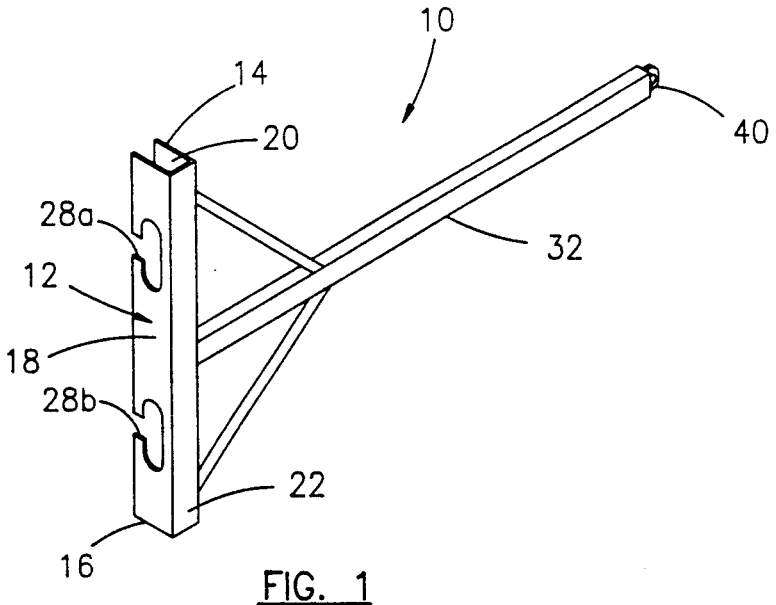
FIG. 1 is a perspective view of the ladder lateral extension showing the basic elements of the invention in its preferred embodiment.
Figure 2:
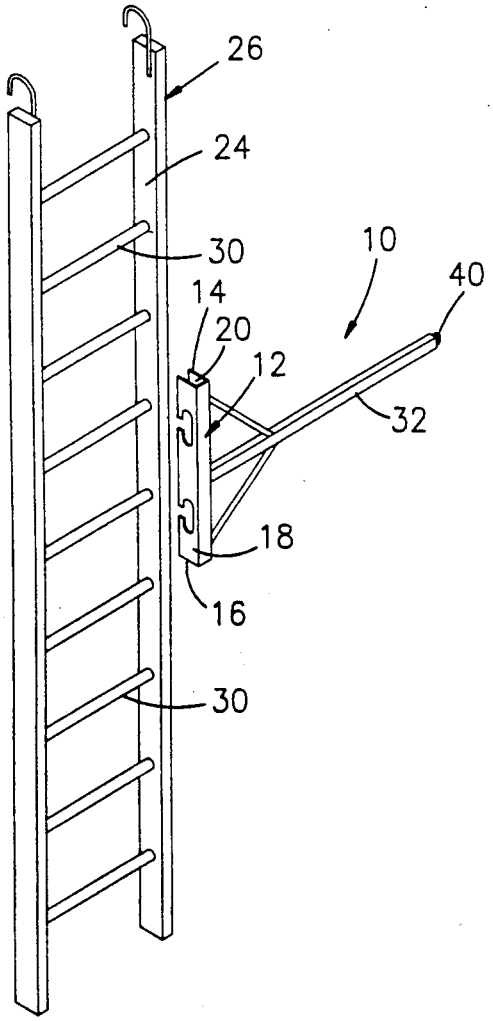
FIG. 2 is perspective view of the ladder lateral extension and a ladder showing how the ladder lateral extension is placed on the ladder.
Figure 3:
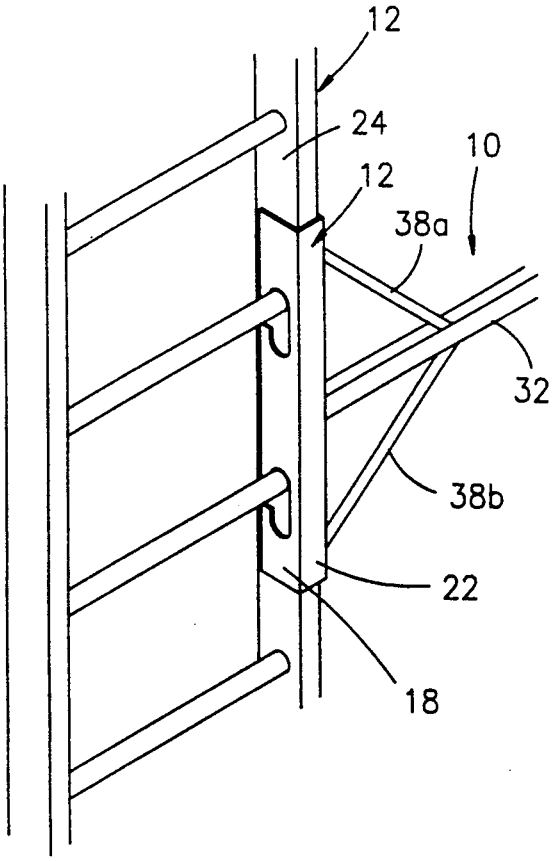
FIG. 3 an enlarged partial perspective view of the ladder lateral extension placed on a ladder showing the rung-receiving slots with rungs therein as the extension is slid along the ladder to move the upper closed ends of the slots around the rungs.
Figure 8:
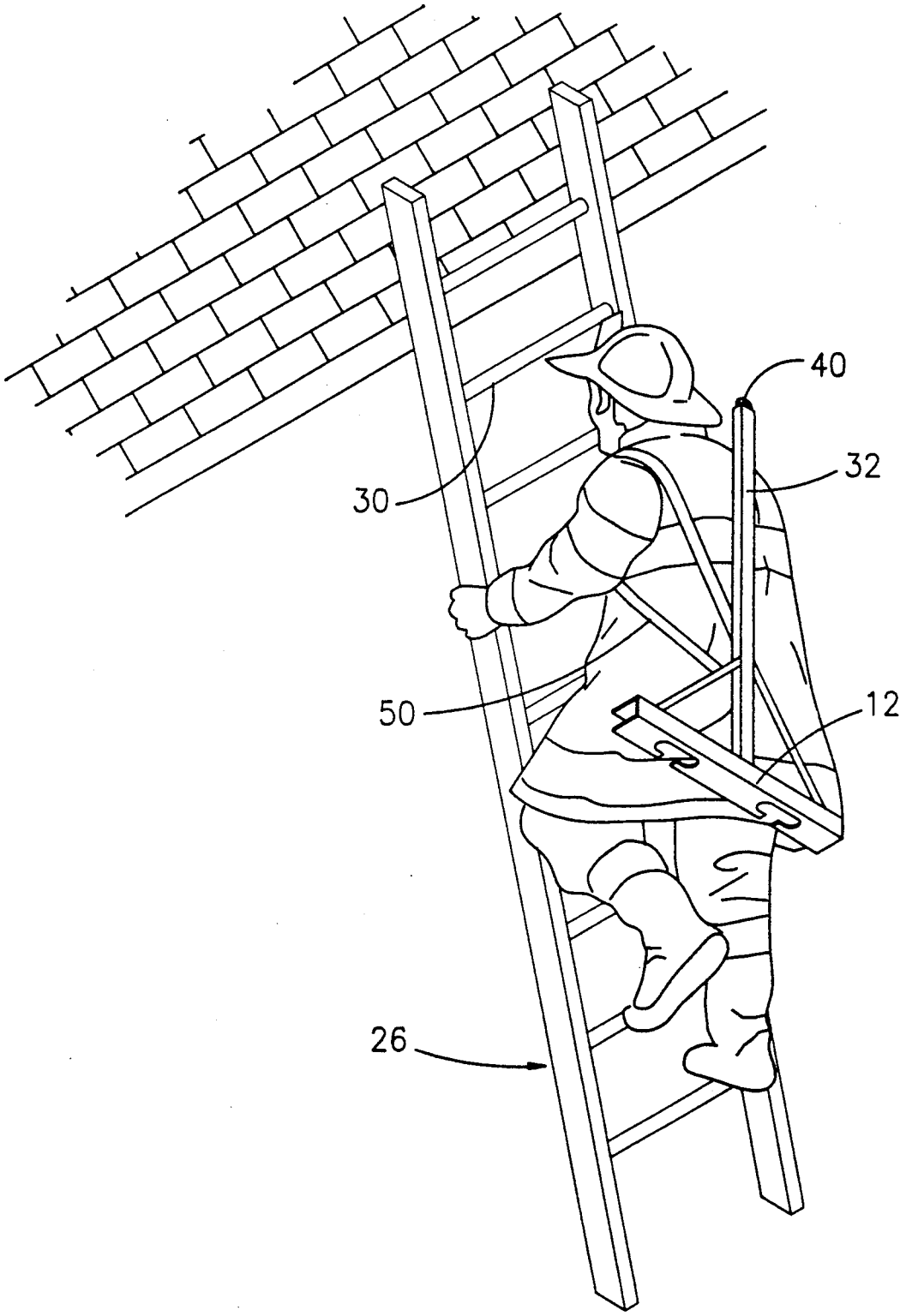
FIG. 8 is a perspective view showing a fireman carrying the ladder lateral extension up a ladder using the carrying strap attached to the extension.
Figure 9:
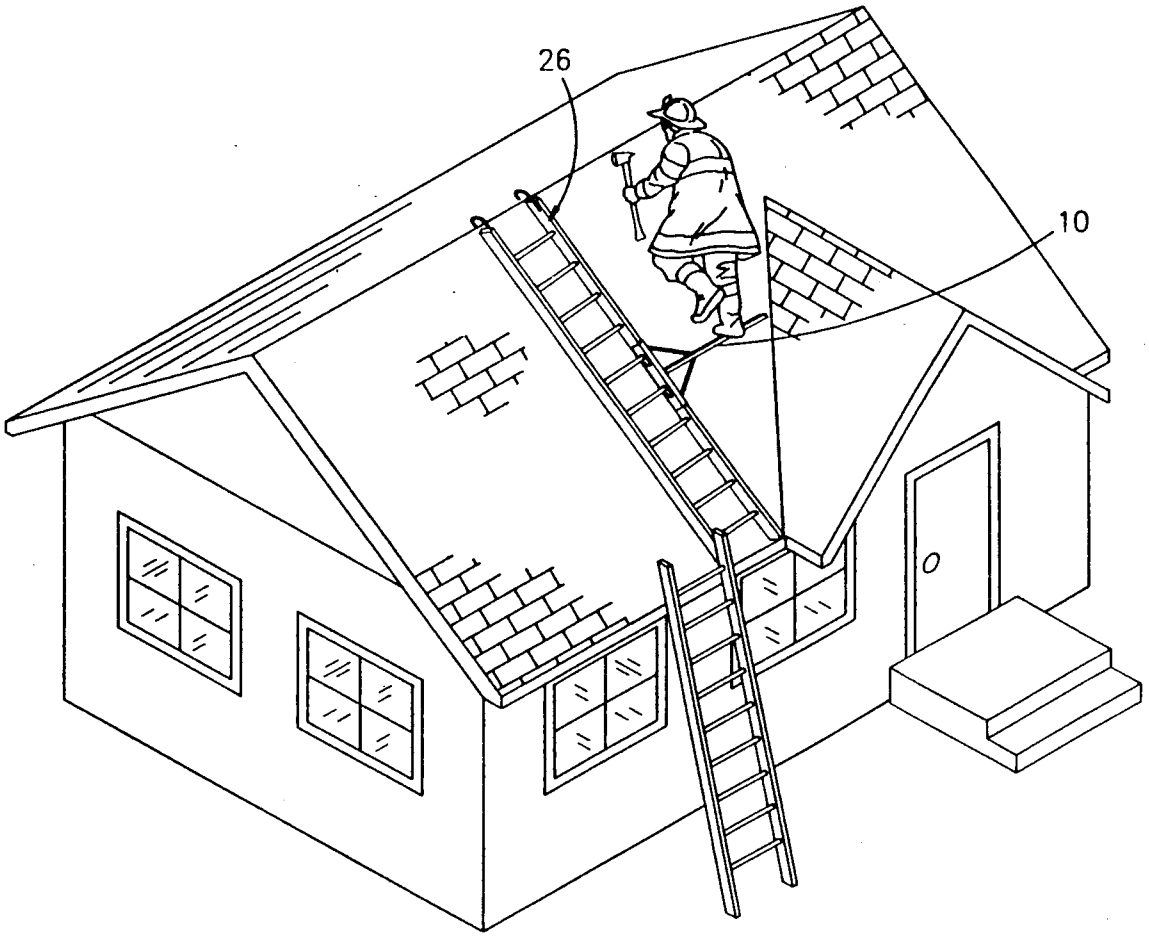
FIG. 9 is a perspective view showing the ladder lateral extension on a roof ladder in place on a roof showing the extension easing access to a gabled area on a roof.

The ladder lateral extension 10 is shown in its preferred embodiment in FIGS. 1–9. The ladder lateral extension 10 is preferably constructed of steel or aluminum for strength and light weight. It includes a generally channel-shaped member 12 having a first end 14 and a second end 16, and further including interior and exterior opposite sidewalls 18 and 20 and a base 22 rigidly connected to and extending between the sidewalls 18 and 20. The channel-shaped member 12 is preferably slightly wider than the siderail 24 of a ladder 26, so that the member 12 may be placed on and slid down over the siderail 24, thus encasing at least a portion of the siderail 24 within the channel-shaped member 12.

To allow the channel-shaped member 12 to slide down over and onto the siderail 24, a pair of rung-receiving slots 28*a* and 28*b* are formed in interior siderail 18 of the channel-shaped member 12. These slots 28*a* and 28*b* are preferably T-shaped, with the lower leg of each T-shaped slot 28*a* and 28*b* being open and adjacent to the edge of the siderail 18 opposite the base 22 of the channel-shaped member 12. Furthermore, the slots 28*a* and 28*b* are longitudinally spaced along the channel-shaped member 12 for registration with respective rungs 30 of a ladder 26. The crossbars of the T-shaped slots 28*a* and 28*b* would preferably allow the channel-shaped member 12 to be slid, thereby resulting in the rungs 30 of the ladder 26 being set in an upper closed end of each T-shaped slot 28*a* and 28*b*, which better secures the ladder lateral extension 10 to the ladder 26.

A lateral support member 32 is preferably mounted on the exterior sidewall 20 and extends exteriorly outwardly and perpendicularly therefrom. It has a first end 34 connected to the sidewall 20 and a opposite second end 36. The lateral support member 32 would be of a length at least as long as the distance between the rung-receiving slots 28*a* and 28*b*, and in the preferred embodiment would be approximately 3' in length. The width and depth dimensions of the lateral support member 32 would preferably be roughly equivalent to the siderail 24 of the ladder 26, or approximately 2"×4".

In the preferred embodiment, a pair of support struts 38*a* and 38*b* would be connected to and extend from respectively, a point near the first end 14 of the channel-shaped member 12 to a point approximately one fourth ($\frac{1}{4}$) of the length of the lateral support member 32 away from the channel-shaped member 12 along the lateral support member 32, and a point near the second end 16 of the channel-shaped member 12 to a point opposite the point described above on the lateral support member 32, thus better supporting the lateral support member 32 when force is applied on it, as when a person stands upon it.

Furthermore, in a preferred embodiment, a spike holder 40 is mounted on the second end 36 of the lateral support member 32. The spike holder 40 is constructed of a flat plate 42 though which a hole 44 is drilled, the hole 44 being of diameter slightly greater than the cross-sectional diameter of a spike 46, so that the spike 46 can be inserted though the hole 44. The top of the spike 46 is of larger diameter than the hole 44, so that the spike 46 will not slide completely though the hole 44. In the preferred embodiment, a nut, washer or similar penetration limiting device 48 would be mounted on the spike 46 approximately 1½" from the tip of the spike 46, thereby preventing the spike 46 from penetrating more than 1½" into the roof or wall, thus facilitating removal of the spike 46 when desired. The combination of the widened top and the penetration limiting device 48 also serves to keep the spike 46 within the spike holder 40, thereby preventing loss or misplacement of the spike 46.

Also, in a preferred embodiment, a carrying strap 50 is detachably fastened to extension 10, perhaps to the support struts 38*a* and 38*b*, each end of the carrying strap 50 being secured to a different strut. The strap 50 would preferably be about 1" wide and made of a water and decay resistant material, such as NYLON. The tool strap 50 would have snap hooks or the like, so that when the strap is not being used to carry the extension up a ladder, it could be threaded through the handle of a power saw, for instance, and then reattached to the support strut to which it had been attached, thus securing the power saw from falling when released by the operator.

Finally, in a preferred embodiment, a non-skid surface could be placed on the footing area of the lateral support member 32, to make the ladder lateral extension 10 even safer for use.

In using the ladder lateral extension 10, the channel-shaped member 12 is placed on a siderail 24 of a ladder 26, such that two rungs 30 are registered with the rung-receiving slots 38*a* and 38*b*. The channel-shaped member 12 is then lowered over the siderail 24, thus moving the slots 38*a* and 38*b* down, so that the rungs 30 are within the slots 38*a* and 38*b*. The channel-shaped member 12 would then be slid along its longitudinal axis, thus moving the slots 38*a* and 38*b* so that the rungs 30 are within the top closed crossbar section of each slot 38*a* and 38*b*. The ladder lateral extension 10 is thus secured upon the ladder 26. To further secure the extension 10 in place, the spike 46 may be driven into the roof upon which the extension 10 is situated.

It is to be understood that dimensions are not critical to the present invention and are merely illustrative of a preferred embodiment.

Likewise, it is to be understood that the above description is not intended to limit in any way the scope of the present invention, and that the scope of the invention shall follow from the claims set forth below.

There has thus been described an invention which accomplishes at least all of the stated objectives.

I claim:

1. A lateral extension for a ladder having a pair of siderails connected by spaced apart rungs, comprising;

a generally channel-shaped member having interior and exterior sidewalls and a base rigidly connected to and extending between said sidewalls, said channel-shaped member being adapted for placement on a ladder siderail for receipt of the siderail within said channel-shaped member, a pair of rung-receiving slots formed in the interior sidewall of said channel-shaped member, each slot having an open end and a closed end, said open ends being situated on an edge of said interior sidewall opposite said base, and spaced apart such that upon placement of said member on a ladder siderail with one slot registered with a ladder rung, both slots receive and hold respective rungs of said ladder; and a lateral support member connected to said channel-shaped member and extending exteriorly from the exterior sidewall thereof substantially perpendicular to said channel-shaped member, said lateral support member being of a length equal to or greater than the distance between said pair of slots in said channel-shaped member.

2. The ladder lateral extension of claim 1, wherein the closed end of each of said pair of rung-receiving slots is wider than said open end whereby upon receipt of a pair of rungs within said slots, said channel-shaped member is slidable on the siderail to move said rungs into said wider closed ends, thereby better securing said rungs in said slots.

3. The ladder lateral extension of claim 2, wherein each of said pair of rung-receiving slots is generally T-shaped including a pair of closed ends on opposite sides of an upright stem portion terminating at said open end.

4. The ladder lateral extension of claim 1 further comprising first and second support struts, said first support strut extending between and connected to said member near one end and said lateral support member, said second support strut extending between and connected to said member near the opposite end and said lateral support member, whereby said lateral support member may support greater weight upon it.

5. The ladder lateral extension of claim 1 further comprising a spike holder mounted on said lateral support member and a spike movably set in said spike holder whereby said spike may be set into a roof or wall, thus securing the ladder lateral extension in place on said roof or said wall.

6. The ladder lateral extension of claim 1 further comprising a carrying strap attached to said ladder lateral extension.

* * * * *